US008469499B2

(12) United States Patent
Rittgers et al.

(10) Patent No.: US 8,469,499 B2
(45) Date of Patent: Jun. 25, 2013

(54) ZONE VENTING IN A FLUID CARTRIDGE

(75) Inventors: Jon Rittgers, Celbridge (IE); John Oliver, Templeogue (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 371 days.

(21) Appl. No.: 12/739,999

(22) PCT Filed: Dec. 7, 2007

(86) PCT No.: PCT/US2007/086741

§ 371 (c)(1),
(2), (4) Date: Apr. 27, 2010

(87) PCT Pub. No.: WO2009/073033

PCT Pub. Date: Jun. 11, 2009

(65) Prior Publication Data

US 2010/0238242 A1 Sep. 23, 2010

(51) Int. Cl.
*B41J 2/175* (2006.01)

(52) U.S. Cl.
USPC ..... 347/86; 347/87

(58) Field of Classification Search
USPC ..... 347/85, 86, 87
See application file for complete search history.

(56) References Cited

U.S. PATENT DOCUMENTS

| | | | | |
|---|---|---|---|---|
| 5,216,450 | A * | 6/1993 | Koitabashi et al. | 347/87 |
| 5,657,065 | A | 8/1997 | Lin | |
| 6,325,498 | B1 | 12/2001 | Higuma et al. | |
| 6,419,349 | B1 | 7/2002 | Iwanaga et al. | |
| 6,749,293 | B1 * | 6/2004 | Jones | 347/86 |
| 7,255,431 | B2 * | 8/2007 | Lui | 347/86 |
| 7,396,117 | B2 * | 7/2008 | Hayashi et al. | 347/86 |
| 7,434,920 | B2 * | 10/2008 | Noguchi et al. | 347/85 |
| 7,938,523 | B2 * | 5/2011 | Aldrich | 347/92 |
| 2004/0080590 | A1 * | 4/2004 | Jung et al. | 347/87 |

FOREIGN PATENT DOCUMENTS

| | | | |
|---|---|---|---|
| EP | 0425254 | A2 | 5/1991 |
| EP | 0765756 | A2 | 4/1997 |
| EP | 1325812 | A1 | 7/2003 |
| JP | 2006082519 | A | 3/2006 |

OTHER PUBLICATIONS

International Search Report Date of Mailing Aug. 26, 2008 for Application No. PCT/US2007/086741 Filing Date Dec. 7, 2007.
EP Search Report received in EP Application No. 07855004.3, mailed Nov. 16, 2010, 8 pages.

* cited by examiner

*Primary Examiner* — Anh T. N. Vo

(57) ABSTRACT

In one embodiment, a cartridge includes: a housing having a chamber therein for holding a fluid; a vent at a first part of the chamber; a porous fluid holding material in the chamber; an outlet from the chamber; and a hole extending through the fluid holding material from the first part of the chamber to a second part of the chamber at a location away from the outlet such that the second part of the chamber is vented through the hole but the outlet is not vented through the hole.

23 Claims, 6 Drawing Sheets

ZONE VENTING IN A FLUID CARTRIDGE

BACKGROUND

In some inkjet printer ink cartridges the ink is held inside the cartridge in a foam ink holding material. Although the foam usually occupies substantially all of an ink holding chamber inside the cartridge, small voids or pockets around the foam may exist, particularly along the bottom and in corners of the ink holding chamber. Also, it may be desirable in some cartridges to only partially fill an ink holding chamber with foam, for example to vary the amount of ink held in the cartridge without also changing the size or shape of the ink holding chamber, thus leaving areas of the ink holding chamber unoccupied by foam. A foam filled ink holding chamber is usually vented to the atmosphere through the lid of the cartridge. Air may become trapped in voids or pockets around the foam or in other areas of the ink holding chamber not occupied by foam if those areas are sealed off from the lid vents. Improper venting in these areas may inhibit the ability of the foam to absorb (or re-absorb) ink that may collect in these areas or otherwise adversely affect performance of the cartridge.

DRAWINGS

Figure 1:
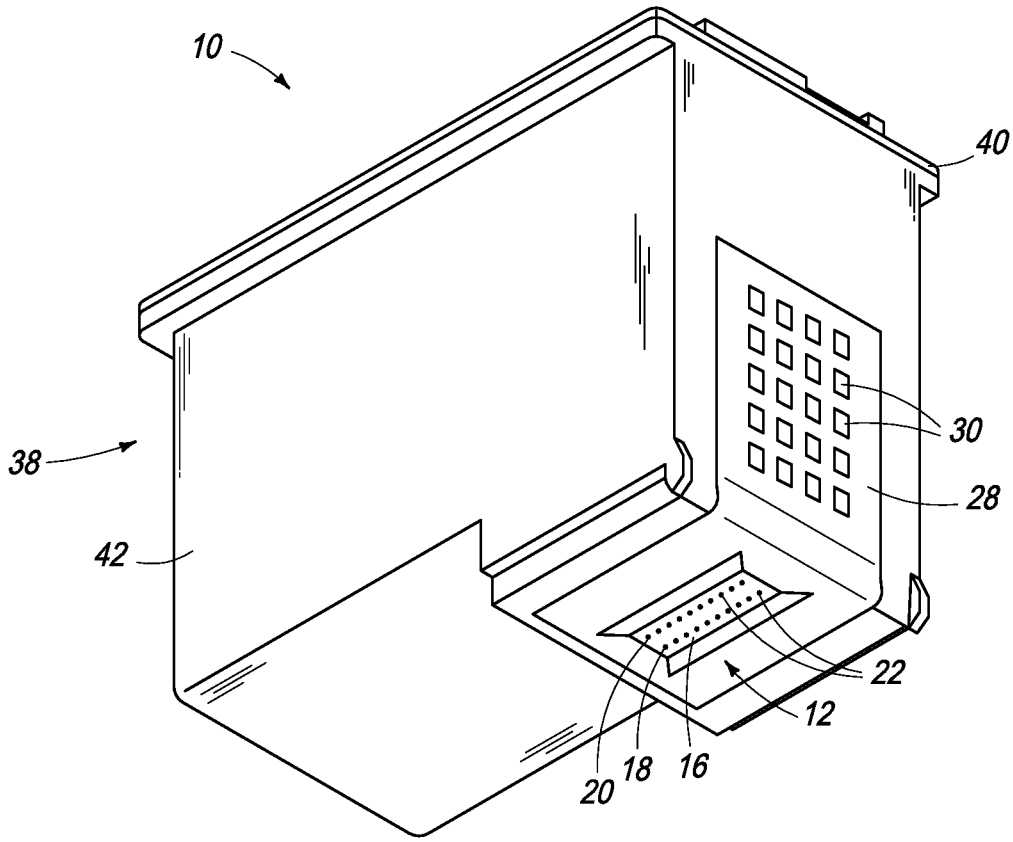
FIG. 1 is a perspective view illustrating the exterior of a black or other single-color ink cartridge.
Figure 2:
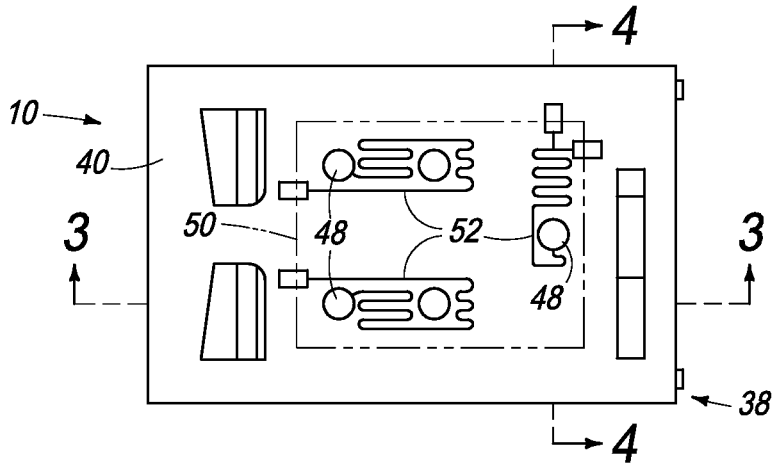
FIG. 2 is a top plan view of the ink cartridge of FIG. 1.
Figure 3:
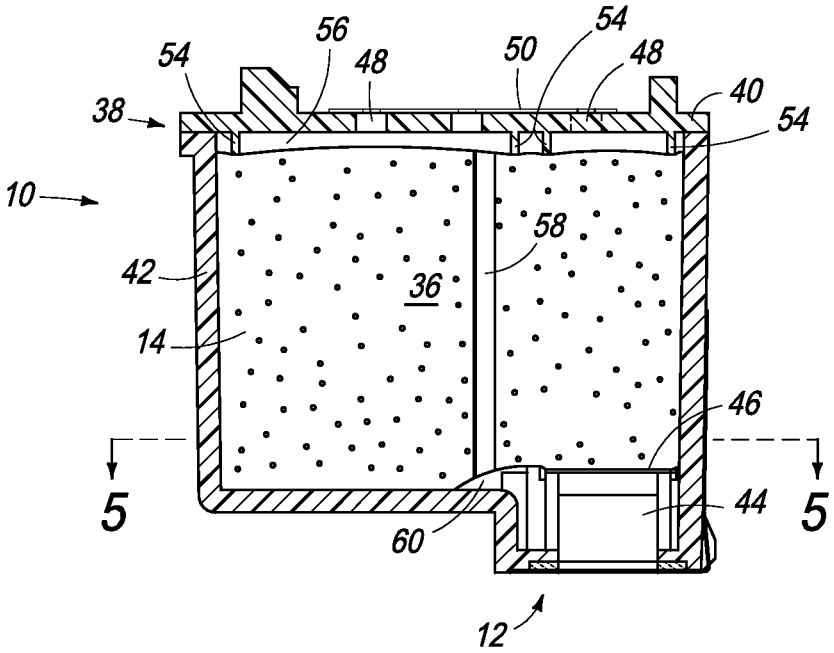
Figure 4:
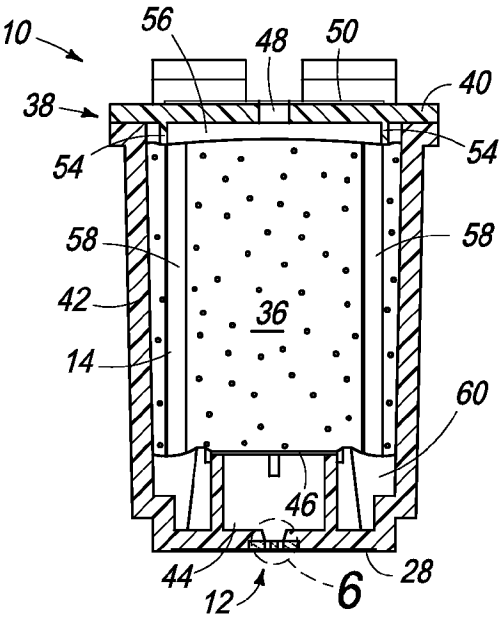

FIGS. 3 and 4 are elevation section views of the cartridge of FIG. 1 taken along the lines 3-3 and 4-4, respectively, in FIG. 2 illustrating one embodiment of the disclosure.

Figure 5:
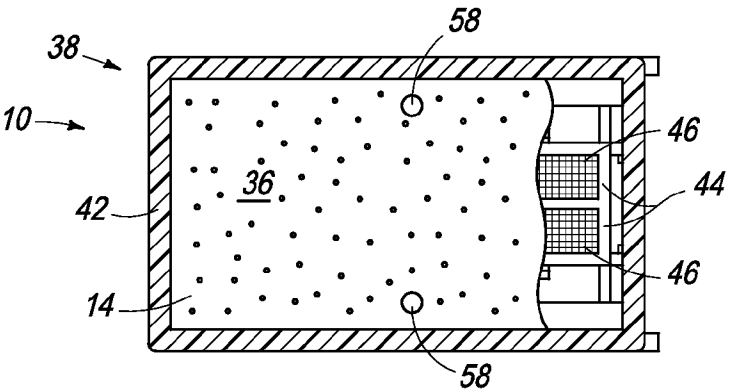

FIG. 5 is a plan section view of the ink cartridge of FIG. 1 taken along the line 5-5 in FIG. 3.

Figure 6:
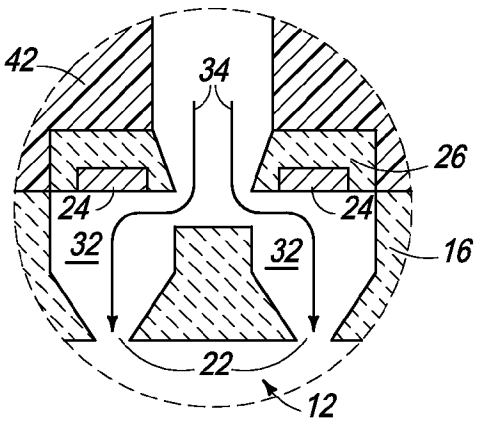

FIG. 6 is a detail section view taken from FIG. 5 showing a portion of the printhead in the cartridge of FIG. 1.

Figure 8:
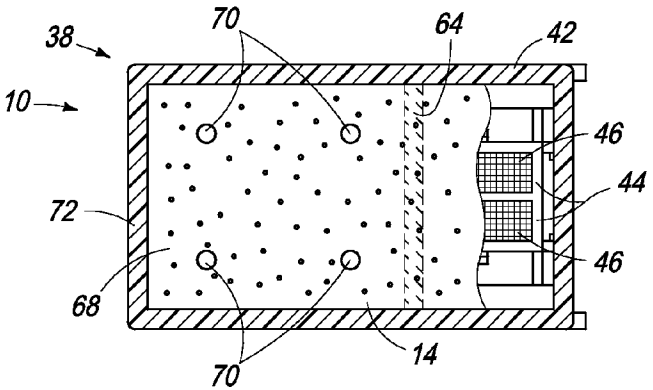
Figure 7:
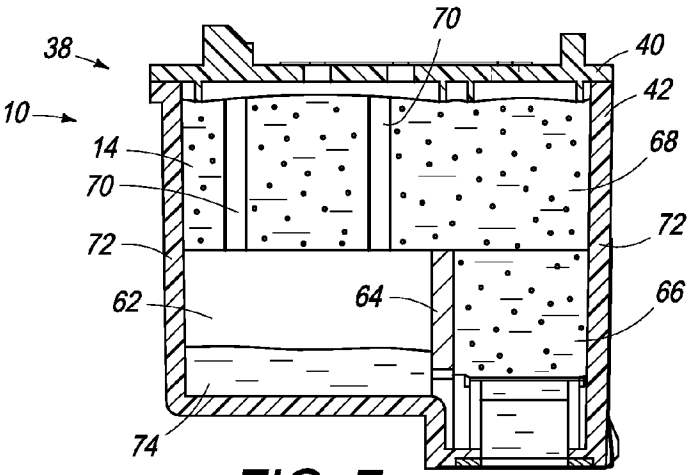

FIGS. 7 and 8 are elevation and plan section views, respectively, of an ink cartridge such as the ink cartridge shown in FIGS. 1 and 2 illustrating another embodiment of the disclosure.

Figure 10:
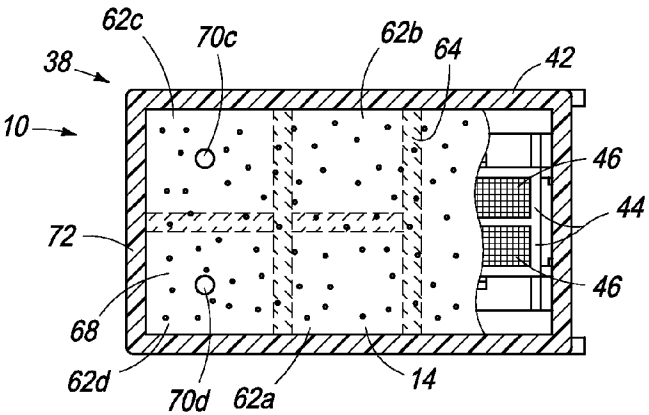
Figure 9:
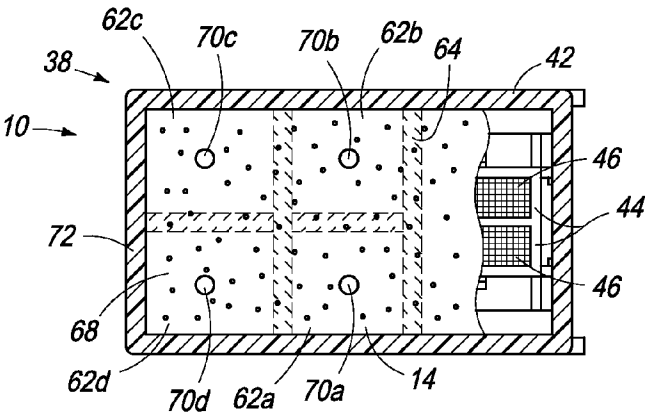

FIGS. 9 and 10 are plan section views an ink cartridge such as the ink cartridge shown in FIGS. 1 and 2 illustrating another embodiment of the disclosure.

Figure 11:
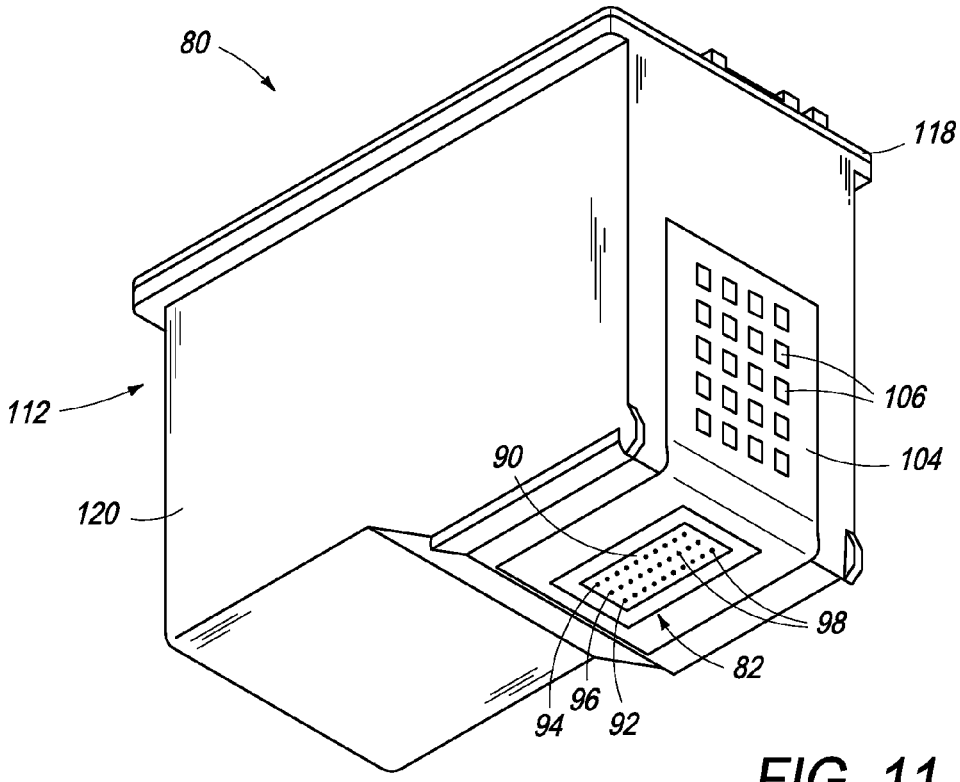

FIG. 11 is a perspective view illustrating the exterior of a three-color ink cartridge.

Figure 12:
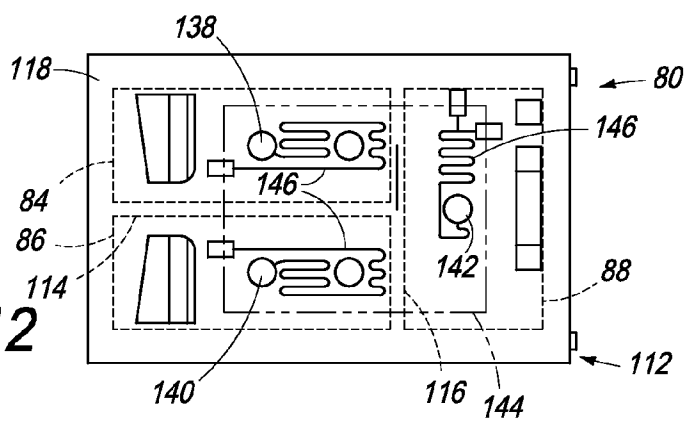

FIG. 12 is a top plan view of the ink cartridge of FIG. 11.

Figure 13:
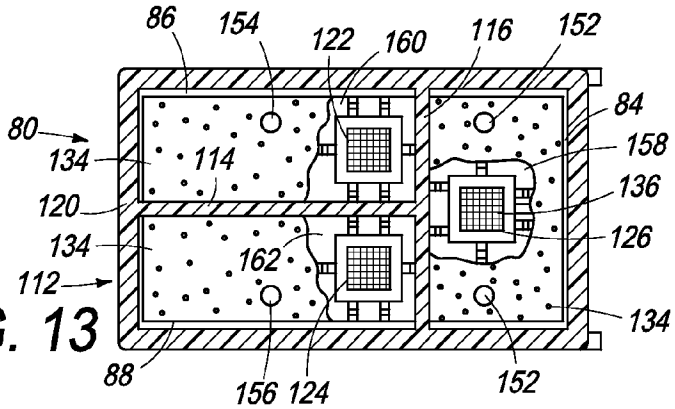
Figure 14:
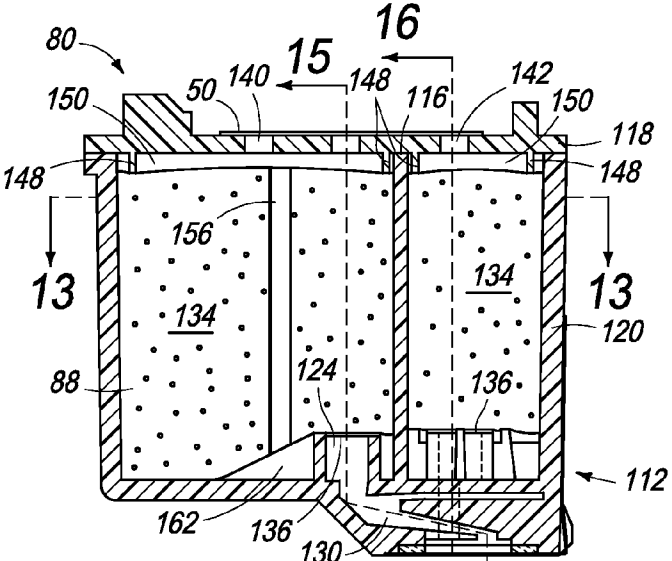

FIG. 13 is a plan section view of the ink cartridge of FIG. 11 taken along the line 13-13 in FIG. 14 illustrating another embodiment of the disclosure.

Figure 15:
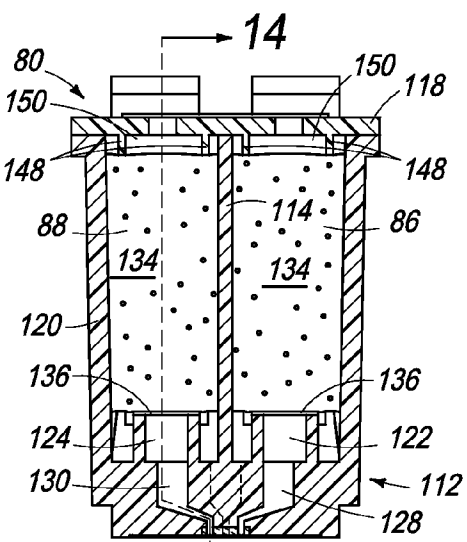

FIG. 14 is an elevation section view of the cartridge of FIG. 11 taken along the line 14-14 in FIG. 15.

Figure 16:
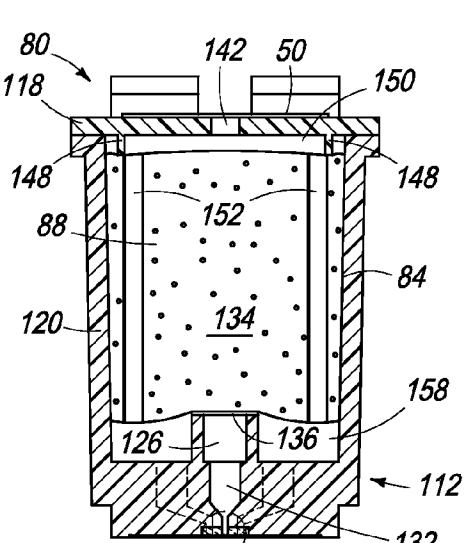

FIGS. 15 and 16 are elevation section views of the ink cartridge of FIG. 11 taken along the lines 15-15 and 16-16, respectively, in FIG. 14.

Figure 17:
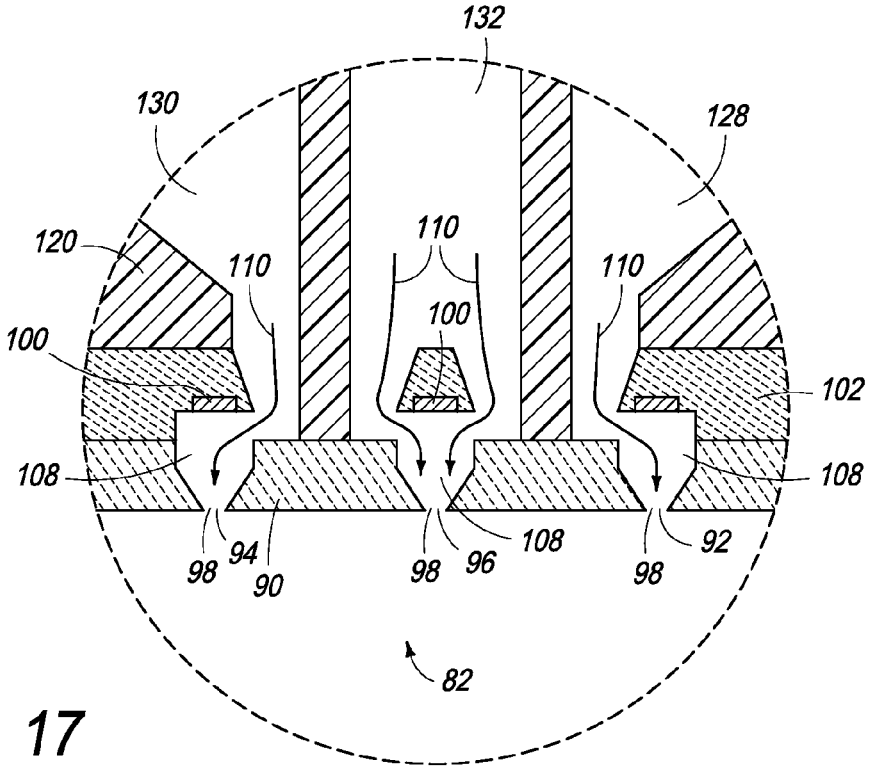

FIG. 17 is a detail section view taken from FIG. 16 showing a portion of the printhead in the cartridge of FIG. 11.

DETAILED DESCRIPTION

Embodiments of the disclosure were developed in an effort to selectively vent free ink regions in an ink cartridge—regions not occupied by the foam or other ink holding material. FIGS. 1-15 illustrate single-color and tri-color ink cartridges for a thermal inkjet printer. Embodiments of the invention might also be implemented with respect to an ink cartridge for other types of inkjet printers, a piezoelectric type inkjet printer for example, or in other kinds of fluid cartridges.

"Vent" or "venting" as used in this document means exposing something to atmospheric pressure. A "vent" as used in this document, therefore, is a structure or feature through which something is exposed to atmospheric pressure.

FIG. 1 is a perspective view of a single-color (typically black) ink cartridge 10. FIG. 2 is a top plan view and FIGS. 3-5 are section views, respectively, of ink cartridge 10. The ink holding foam is cut-away in FIG. 5 to more clearly illustrate some of the internal features of ink cartridge 10. FIG. 6 is a detail section view of a portion of the printhead in cartridge 10.

Referring to FIGS. 1-6, cartridge 10 includes a printhead 12 located at the bottom of cartridge 10 below an ink holding chamber 14. Printhead 12 includes a nozzle plate 16 with two arrays 18, 20 of ink ejection nozzles 22. In the embodiment shown, each array 18, 20 is a single row of nozzles 22. As shown in the detail view of FIG. 6, firing resistors 24 formed on an integrated circuit chip 26 are positioned behind ink ejection nozzles 22. A flexible circuit 28 carries electrical traces from external contact pads 30 to firing resistors 24. When ink cartridge 10 is installed in a printer, cartridge 10 is electrically connected to the printer controller through contact pads 30. In operation, the printer controller selectively energizes firing resistors 24 through the signal traces in flexible circuit 28. When a firing resistor 24 is energized, ink in a vaporization chamber 32 next to a resistor 24 is vaporized, ejecting a droplet of ink through a nozzle 22 on to the print media. The low pressure created by ejection of the ink droplet and cooling of chamber 32 then draws in ink to refill vaporization chamber 32 in preparation for the next ejection. The flow of ink through printhead 12 is illustrated by arrows 34 in FIG. 6.

Ink is held in foam 36 or another suitable porous material in ink chamber 14 formed within a cartridge housing 38. Housing 38, which is typically molded plastic, may be molded as a single unit, molded as two parts (e.g., a lid 40 and a body 42) or constructed of any number of separate parts fastened to one another in the desired configuration. An outlet 44 to printhead 12 is located near the bottom of ink chamber 14. A filter 46 covering outlet 44 is often used to keep contaminants, air bubbles and ink flow surges from entering printhead 12 during operation. Foam 36 is usually compressed around filter 46 and outlet 44 to increase its capillarity in the region of outlet 44. As ink is depleted from foam 36, the increased capillarity near outlet 44 tends to draw ink from all other portions of foam 36 to maximize the amount of ink drawn from chamber 14.

Referring now specifically to FIGS. 2-4, openings 48 formed in lid 40 are covered by a label or other suitable adhesive sheet 50. Openings 48 are exposed to the atmosphere through circuitous tunnels 52. Each tunnel 52, commonly referred to as a labyrinth, is formed by a recess in the top of lid 40 that extends past the edge of label 50. Labyrinths, which are well known in the art of inkjet printing, are commonly used for venting ink cartridges to slow the rate of evaporation. Spacers 54 projecting down from the bottom of lid 40 hold foam 36 off lid 40 to provide a gap 56 between foam 36 and lid 40. Gap 56 helps vent ink holding chamber 14 to the atmosphere through openings 48 and labyrinths 52.

Gap 56 also helps prevent ink wicking out from foam 36 through the holes 48 and blocking the labyrinths 52. If labyrinths 52 become blocked, the backpressure (i.e., negative pressure) in foam 36 may become unstable. Backpressure in foam 36 is generated by the capillary forces created by menisci at the interfaces in foam 36 between ink and air. Venting gap 36 through openings 48 and labyrinths 52 maintains the pressure in gap 56 at atmospheric pressure. Changes in pressure in gap 56 changes the backpressure in foam 36. If the pressure in gap 56 is higher than atmospheric pressure (i.e., positive pressure), the backpressure in foam 36 becomes less negative, the force holding ink in cartridge 10 is less than normal and ink may drool from nozzles 22. If the pressure in gap 56 is less than atmospheric pressure, the backpressure in foam 36 becomes more negative, the force holding ink in cartridge 10 is greater than normal and ink will flow less quickly (or not at all) to printhead 12 during printing.

Referring to FIGS. 3-5, holes 58 are formed through foam 36 to vent selected areas or "zones" of ink chamber 14. In the example configuration shown in FIGS. 3-5, a pair of two holes 58 vent a void 60 under foam 36 around outlet 44. Void 60 is an area around outlet 44 not occupied by foam 36. Without vent holes 58 in foam 36, void 60 may be sealed off from lid vents 48 and, consequently, any free ink (ink not held in foam 36) collecting in void 60 may not be absorbed or re-absorbed into foam 36.

Other configurations are possible. For example, in the configuration of cartridge 10 shown in FIGS. 7 and 8, ink chamber 14 includes a free ink zone 62 at a rear part of chamber 14 defined by a partition 64 separating free ink zone 62 from outlet 44. Foam 36 includes two foam blocks 66 and 68. Free ink zone 62 is vented through holes 70 in upper, cap foam block 68. Lower, filter cap foam block 66 covering outlet 44 and filter 46 is constrained by partition 64 and chamber walls 72. Thus, block 66 may be compressed around filter 46 and outlet 44 to increase the capillarity in the region of outlet 44. As ink is depleted from block 66, the increased capillarity near outlet 44 draws in ink from other portions of block 66 and from block 68. This capillary action also draws ink 74 from free ink in zone 62 up along partition 64 and chamber walls 72 into block 68. Absent the consistent venting provided by holes 70, free ink zone 62 may or may not be vented depending on the level of ink in foam 68, resulting in the partial and/or unintentional venting of zone 62. Thus, consistent venting through holes 70 improves control over "drool" caused by erratic changes in backpressure in foam 38 and over the absorption of free ink 74 into foam 68.

In other examples, vent holes are used selectively to vent one or more multiple free ink zones. FIGS. 9-10 illustrate different venting configurations for an ink cartridge 10 partitioned into multiple free ink zones 62*a*-62*d* below foam block 68. In the configuration shown in FIG. 9, each free ink zone 62*a*-62*d* is vented through a corresponding hole 70*a*-70*d* so that any free ink in zones 62*a*-62*d* tends to be constantly drawn up into foam 68. In the configuration of FIG. 10, only the rear zones 62*c* and 62*d* are vented through associated vent holes 70*c* and 70*d*. In the configuration of FIG. 10, any ink in zones 62*c* and 62*d* tends constantly to be drawn up into foam 68. The absorption of any ink in zones 62*a* and 62*b* will be controlled primarily by the condition of foam 68. Thus, when the level of ink in foam 68 is such that zones 62*a* and 62*b* are effectively sealed off from gap 56 and lid vents 48, then ink in zones 62*a* and 62*b* will tend not to be drawn up into foam 68, remaining largely unabsorbed by foam 68. When the level of ink in foam 68 is such that zones 62*a* and 62*b* are effectively exposed to gap 56 and lid vents 48, venting zones 62*a* and 62*b* (for example as foam 68 dries out in the area above zones 62*a* and 62*b*), then ink in zones 62*a* and 62*b* will tend to be drawn up into foam 68 until foam 68 is sufficiently saturated with ink to again seal off zones 62*a* and 62*b* from gap 56 and lid vents 48.

The configuration of FIG. 9 corresponds to an ink fill scenario for cartridge 10 in which the volume of ink inserted into chamber 14 is not greater than the holding capacity of foam 36 and 38. In this ink fill scenario, free ink zones 62*a*-62*d* are not used purposely to store ink. The configuration of FIG. 10 corresponds to an ink fill scenario for cartridge 10 in which free ink zones 62*a* and 62*b* may be used purposely to store ink. In this ink fill scenario, ink inserted into zones 62*a* and 62*b* will tend to remain there until ink is depleted from foam 36, allowing venting of zones 62*a*, 62*b* through foam 36 as described above. The use of different configurations for selectively venting free ink zones 62 within ink holding chamber 14 thus allows for a corresponding variety of ink fill levels in a single configuration of cartridge housing 38.

FIGS. 11-17 illustrate a three color ink cartridge 80 for a thermal inkjet printer. FIG. 11 is a perspective view of cartridge 80. FIG. 12 is a top plan view and FIGS. 13-16 are section views of ink cartridge 80. The ink holding foam is cut-away in FIG. 13 to more clearly illustrate some of the internal features of ink cartridge 80. FIG. 17 is a detail section view of a portion of the printhead in cartridge 80. Referring to FIGS. 13-17, cartridge 80 includes a printhead 82 located at the bottom of cartridge 80 below ink chambers 84, 86 and 88. Printhead 82 includes a nozzle plate 90 with three arrays 92, 94 and 96 of ink ejection nozzles 98. In the embodiment shown, each array 92, 94 and 96 is a single row of nozzles 98. As shown in FIG. 15, firing resistors 100 formed on an integrated circuit chip 102 are positioned behind ink ejection nozzles 98. A flexible circuit 104 carries electrical traces from external contact pads 106 to firing resistors 100.

When ink cartridge 80 is installed in a printer, cartridge 80 is electrically connected to the printer controller through contact pads 106. In operation, the printer controller selectively energizes firing resistors 100 through the signal traces in flexible circuit 104. When a firing resistor 100 is energized, ink in a vaporization chamber 108 (FIG. 17) next to a resistor 100 is vaporized, ejecting a droplet of ink through nozzle 98 on to the print media. The low pressure created by ejection of the ink droplet and cooling of chamber 108 then draws in ink to refill vaporization chamber 88 in preparation for the next ejection. The flow of ink through printhead 102 is illustrated by arrows 110 in FIG. 17.

Referring now to the section views of FIGS. 13-16, ink is stored in three chambers 84, 86 and 88 formed within cartridge housing 112. Each chamber 84, 86 and 88 may be used to store a different color ink, cyan, magenta and yellow for example. Ink chambers 84, 86 and 88 are separated from one another by partitions 114 and 116. Housing 112, which is typically formed from a plastic material, may be molded as a single unit, molded as two parts (e.g., a lid 118 and a body 120 that includes partitions 114 and 116) or constructed of any number of separate parts fastened to one another in the desired configuration. An outlet 122, 124 and 126 is located near the bottom of each ink chamber 84, 86 and 88, respectively. A conduit 128, 130 and 132 leads from each outlet 122, 124 and 126, respectively. Ink passes from each chamber 84, 86 or 88 through a corresponding outlet 122, 124 or 126 and conduit 128, 130 or 132 to printhead 82, where it is ejected through the corresponding nozzle array 92, 94 or 96, as described above.

Ink is held in foam 134 or another suitable porous material in each ink chamber 84, 86 and 88. A filter 136 covering each outlet 122, 124, and 126 is typically used to keep contaminants, air bubbles and ink flow surges from entering printhead 82 during operation. Foam 134 is usually compressed around filters 136 and outlets 122, 124 and 126 to increase its capillarity in the region of outlets 122, 124 and 126. As ink is depleted from foam 134, the increased capillarity near the outlet tends to draw ink from all other portions of foam 134 to maximize the amount of ink drawn from each chamber 84, 86 and 88.

Openings 138, 140, and 142 formed in lid 118 are covered by a label or other suitable adhesive sheet 144. Vent openings 138, 140 and 142 are exposed to the atmosphere through circuitous tunnels 146. Each tunnel 146, commonly referred to as a labyrinth, is formed by a recess in the top of lid 118 that extends past the edge of label 144. Spacers 148 projecting down from the bottom of lid 118 hold foam 134 off lid 118 to provide a gap 150 between foam 134 and lid 118. Gap 150 helps vent ink holding chambers 84, 86 and 88 to the atmosphere through openings 138, 140, 142 and labyrinths 146. Referring to FIGS. 13-16, holes 152, 154 and 156 are formed through foam 134 to vent selected areas or "zones" of each ink chamber 84, 86 and 88. In the example configuration shown in FIGS. 13-16, a pair of holes 152 vent a void 158 around outlet 122 in chamber 84. Single holes 154, 156 vent voids 160, 162 in chambers 86, 88, respectively.

For effective venting air must be able to pass through each vent hole. Thus, the diameter of each vent hole (or other cross-sectional dimension for non-circular holes) should be significantly greater than the nominal pore size of the foam to prevent an ink meniscus clogging the vent hole. Nominal pore sizes in foam ink holding materials commonly used in inkjet ink cartridges range from about 0.1 mm for felted foam to about 0.6 mm for unfelted foam. (Felting refers to the desired and controlled compression of the pores in the foam.) The cross-sectional dimension of each vent hole should be in the range of 5 to 50 times greater than the nominal pore size for these types of foam to help minimize the risk of menisci clogging the vent hole. Also, since air transported to the filter/outlet can seriously degrade performance of the ink cartridge, the vent holes should be located sufficiently far away from the ink filter(s)/outlet(s) to so that a liquid barrier can form around the filter/outlet to help prevent venting air to the filter/outlet.

It is advantageous to form the vent holes after the ink holding foam is inserted into the cartridge. Forming vent holes after foam insertion (1) eliminates the risk that the holes will collapse as the foam is compressed during insertion and (2) helps ensure that vent hole formation does not affect felting in other areas of the foam. In one suitable technique for forming vent holes, a heated rod having the desired size and shape is pressed down through the foam after the foam has been inserted into the ink cartridge. Multiple vent holes may be formed by repeatedly pressing a single rod into the foam at the desired vent hole locations. Alternatively, an array of heated rods may be used to form multiple vent holes simultaneously. Unlike water jets, air knives, and other cutting tools that can generate cutting debris, a heated rod reduces the risk of introducing small foam particles into the ink holding chamber—particles that could clog the filter or otherwise degrade performance of the ink cartridge.

The use of a heated rod is also advantageous to control the characteristics of the inside surface of the vent hole. At lower temperatures, about 260° C. for polyurethane foam for example, in which more pressure is needed to form the vent hole, the capillary network is softened by the heat and then mechanically broken and deformed but remains an open network. At higher temperatures, over 300° C. for polyurethane foam for example, the foam is melted back and the surface network in the hole is partially or fully closed. The heat affected zone, however, is minimal and the capillary network beyond this internal shell remains unchanged. There is potential utility in both kinds of hole structure. The first structure, in which the capillary network is still open, allows more evaporation from the ink off the larger surface area while the second structure, in which the capillary network is closed, retards evaporation. Also, the number of capillaries available to affect backpressure in the foam may be controlled in part by the number of vent holes and the surface characteristics of the vent holes (open capillary/cell, partially closed capillary/cell, and/or fully closed capillary/cell) formed in the ink holding foam. Although the actual temperature used to form a vent hole may vary depending on the specific type of foam and the desired hole characteristics, it is expected that a temperature in the range of 225° C. to 400° C. will provide suitable results for most polyurethane foam ink holding materials.

The article "a" as used in the following claims means one or more. Thus, for example, "a hole extending through the ink holding material" means one or more holes extending through the ink holding material and, accordingly, a subsequent reference to "the hole" refers the one or more holes.

The present disclosure has been shown and described with reference to the foregoing exemplary embodiments. It is to be understood, however, that other forms, details and embodiments may be made without departing from the spirit and scope of the disclosure which is defined in the following claims. For example, a cartridge according to other embodiments may be used to dispense fluids other than inks.

What is claimed is:

1. A cartridge, comprising:

a housing having a chamber for holding a fluid, the chamber having an upper portion an a lower portion;

a vented lid to cover the chamber;

an outlet extending from the lower portion of the chamber; and a porous fluid holding material positioned within the chamber to define a a voided area that (i) is adjacent to the outlet and (ii) is not occupied by the porous fluid holding material, the voided area being defined between a wall of the chamber and the porous fluid holding material, the porous fluid holding material including a hole that extends through from the upper portion of the chamber to the voided area adjacent to the outlet such that the voided area is vented through the hole and the vented lid, but the outlet is not vented through the hole.

2. The cartridge of claim 1, wherein the fluid comprises ink.

3. The cartridge of claim 1, wherein the fluid holding material comprises foam.

4. The cartridge of claim 3, wherein the hole is defined by a surface within the foam, the surface being characterized a capillary network in the foam.

5. The cartridge of claim 3, wherein the hole is defined by a surface within the foam, the surface being characterized by a shell in which the foam has been melted and a capillary network in the foam destroyed, and the shell surrounded by foam in which the capillary network remains intact.

6. The cartridge of claim 1, further comprising a printhead affixed to the housing, the printhead operatively connected to the chamber through the outlet.

7. The cartridge of claim 1, wherein the hole comprises a hole having a cross sectional dimension in the range of 5 to 50 times greater than a nominal pore size of the fluid holding material.

8. A cartridge, comprising:

a chamber for holding a fluid, the chamber including an upper portion and a lower portion;

an outlet extending from the lower portion of the chamber;

a plurality of foam portions positioned within the chamber to define a free fluid area in the lower portion of the chamber that is not occupied by any of the plurality of foam portions, the free fluid area being further defined by a partition in the lower portion of the chamber and at least one of the plurality of foam portions in the upper portion of the chamber;

wherein the plurality of foam portions includes a first foam portion that is positioned within the chamber to cover the outlet, the first foam portion being constrained between the partition and a chamber wall; and wherein one of the plurality of foam portions that does not cover the outlet includes a hole that (i) extends through from a vented area of the upper portion of the chamber to the free fluid area and (ii) dies not extend through the first foam portion.

9. The cartridge of claim 8, wherein the fluid comprises ink.

10. The cartridge of claim 8, further comprising:

at least a second free fluid area defined by at least a second area within the lower portion of the chamber that is not occupied by any one of the plurality of foam portions, the at least the second free fluid area being further defined by the partition in the lower portion of the chamber and the at least one of the plurality of foam portions in the upper portion of the chamber; and wherein another one of the foam portions that does not cover the outlet includes at least a second hole that (i) extends through from the vented area of the upper portion of the chamber to the at least the second free fluid area and (ii) does not extend through the first foam portion.

11. The cartridge of claim 10, wherein there are fewer total number of holes than total number of free fluid areas.

12. An ink cartridge, comprising:

a housing having a chamber for holding ink;

a vented lid of the chamber;

an outlet extending from a lower portion of the chamber in which ink can be dispensed;

a foam positioned within the chamber to hold ink, the foam being positioned so that a gap exists between an upper portion of the foam and the vented lid;

wherein the foam is positioned within the chamber to define a voided area that is (i) adjacent to the outlet and (ii) is not occupied by the foam, the voided area being defined between an wall of the chamber and the foam, wherein the foam includes a hole extending through from the upper portion of the foam to the voided area adjacent to the outlet such that the voided area is vented through the hold and the vented lid.

13. The ink cartridge of claim 12, wherein the foam includes one or more additional holes extending through from the upper portion of the foam to the voided area adjacent to the outlet.

14. The ink cartridge of claim 12, wherein the hole is defined by a surface within the foam, the surface being characterized a capillary network in the foam.

15. The ink cartridge of claim 12, wherein the hole is defined by a surface within the foam, the surface being characterized by a shell in which the foam has been melted and a capillary network in the foam destroyed, and the shell surrounded by foam in which the capillary network remains intact.

16. The ink cartridge of claim 12, further comprising a printhead operatively connected to the chamber through the outlet.

17. A method for manufacturing an ink cartridge, the method comprising:

inserting a foam ink holding material into an ink chamber in a body of the ink cartridge to define a voided region that is adjacent to an outlet of the ink and is not occupied by the foam ink holding material, the voided region being defined between a wall of the ink chamber and the foam ink holding material; and then forming, by applying heat, a hole through the foam ink holding material from an upper surface of the foam ink holding material to the voided region adjacent to the outlet so that the voided region of the ink chamber is vented through the hole.

18. The method of claim 17, further comprising installing a lid on the body to cover the ink chamber, and then adding ink to the foam ink holding material in the ink chamber.

19. The method of claim 17, wherein forming the hole by applying heat comprises inserting a heated rod into the foam ink holding material.

20. The method of claim 19, wherein inserting a heated rod into the foam ink holding material comprises inserting the heated rod having a temperature in the range of 225° C. to 400° C. into the foam ink holding material.

21. The method of claim 17, wherein forming the hole by applying heat comprises forming a plurality of holes serially by inserting a single heated rod repeatedly into the foam ink holding material.

22. The method of claim 17, wherein forming the hole by applying heat comprises forming a plurality of holes simultaneously by inserting an array of heated rods into the foam ink holding material.

23. The method of claim 17, wherein forming the hole by applying heat comprises applying pressure and heat to the foam ink holding material simultaneously.

* * * * *

UNITED STATES PATENT AND TRADEMARK OFFICE

CERTIFICATE OF CORRECTION

PATENT NO. : 8,469,499 B2
APPLICATION NO. : 12/739999
DATED : June 25, 2013
INVENTOR(S) : Jon Rittgers et al.

It is certified that error appears in the above-identified patent and that said Letters Patent is hereby corrected as shown below:

In the Claims:

In column 6, line 27, in Claim 1, delete "cartridge," and insert - - cartridge - -, therefor.

In column 6, line 29, in Claim 1, delete "an" and insert - - and - -, therefor.

In column 6, line 34, in Claim 1, delete "a a" and insert - - a - -, therefor.

In column 6, line 47, in Claim 4, delete "characterized" and insert - - characterized by - -, therefor.

In column 6, line 61, in Claim 8, delete "cartridge," and insert - - cartridge - -, therefor.

In column 7, line 12, in Claim 8, delete "dies" and insert - - does - -, therefor.

In column 7, line 30, in Claim 12, delete "cartridge," and insert - - cartridge - -, therefor.

In column 7, line 32, in Claim 12, delete "of" and insert - - to cover - -, therefor.

In column 7, line 41, in Claim 12, delete "an" and insert - - a - -, therefor.

In column 7, line 45, in Claim 12, delete "hold" and insert - - hole - -, therefor.

In column 8, line 3, in Claim 14, delete "a" and insert - - by a - -, therefor.

In column 8, line 33, in Claim 20, delete "a" and insert - - the - -, therefor.

Signed and Sealed this
Tenth Day of September, 2013

Teresa Stanek Rea
*Acting Director of the United States Patent and Trademark Office*